United States Patent [19]

Willis

[11] 3,944,110

[45] Mar. 16, 1976

[54] COMBINED TRASH AND ASH RECEPTACLE

[76] Inventor: William B. Willis, 3204 Evans St., Morehead City, N.C. 28557

[22] Filed: Jan. 8, 1975

[21] Appl. No.: 539,506

[52] U.S. Cl. ..... 220/23.83; 220/20.5

[51] Int. Cl.[2] ..... A47G 19/00; B65D 21/02

[58] Field of Search ..... 220/23.83, 23, 20, 1 H, 220/90.4, 20.5; 206/501

[56] References Cited

UNITED STATES PATENTS

| | | | |
|---|---|---|---|
| 2,047,876 | 7/1936 | Knepp | 206/501 X |
| 2,142,647 | 1/1939 | Heller | 220/1 H X |
| 2,327,078 | 8/1943 | Teetor | 220/23.83 |
| 2,635,762 | 4/1953 | Shaw | 206/501 X |
| 2,894,655 | 7/1959 | Bergan | 220/1 H |

*Primary Examiner*—William Price
*Assistant Examiner*—Steven M. Pollard

[57] ABSTRACT

Cigarette ashes and small trash particles are deposited and maintained in separate areas of a receptacle which is designed for use primarily in small areas as on restaurant dining tables.

3 Claims, 6 Drawing Figures

COMBINED TRASH AND ASH RECEPTACLE

BACKGROUND

In restaurants and other establishments where people gather and also in homes, the convenient disposition of small trash papers such as crackers, candy and gum wrappers or empty cigarette packages is a problem. Such wrappers should not be placed in receptacles containing cigarette ashes because of their flammability. Further, ash trays are generally too shallow to hold trash papers. Thus the papers are scattered about on the table, thereby creating a disorderly appearance. Additionally, the table which is littered by small papers requires increased time by restaurant or domestic personnel to clean.

Previously ash trays have been combined with containers such as for tobacco, cigarettes and matches. For examples, see U.S. Pat. Nos. 1,184,881 and 1,588,043. Most of these devices serve as smoker's appliances by providing a container for the tobacco or cigarettes and a combined closure-ash tray. The closure-ash trays are generally designed to function as covers for the containers until the tobacco or cigarettes are depleted and the containers discarded. Further, the closure-ash tray must be removed to gain access into the container.

It is also known in the prior art to have ash trays with collapisible bottoms functioning to empty ashes from the ash tray into a larger container below. These receptacles are designed to receive large quantities of ashes before emptying is necessary and are not designed to be trash receptacles. Any trash deposited in them is mixed with the ashes and is subject to catching fire.

SUMMARY

The present invention is a receptacle combining separate areas for the containment of tobacco ashes and trash papers. It comprises a fire resistant upper container for holding ashes and a base container for holding trash. The base container has means for supporting the upper container and an opening or openings through which trash may be deposited into the container without removing the upper ash container.

The preferred embodiment is a receptacle of such size as to be placed atop a restaurant dining table or small table within the home without requiring excessive space. It eliminates the aforementioned problems by providing an ash receptacle for use by smokers and underneath, with separate access thereto, a larger container in which discarded food wrappers, empty cigarette packages and other articles of like nature may be placed. The appearance of the surrounding areas will be obviously improved and the table cleaning time required by restaurant or domestic personnel will be decreased by eliminating the necessity for gathering many individual pieces of paper.

It is therefore an object of the invention to provide a receptacle having separate compartments for the separate containment of ashes and small trash papers.

It is also an object of the invention to provide a receptacle of the type described small enough to place atop a restaurant dining table or other small table.

It is a further object of the invention to provide an article of manufacture which aids in decreasing the time required by restaurant or domestic personnel to clean restaurant tables and the surrounding area of ashes and paper wrappers.

other objects and advantages of the present invention will become apparent upon reading the following detailed specification in association with the accompanying drawings, in which.

DETAILED DESCRIPTION OF THE DRAWINGS

Figures 1, 3, 5, 6:
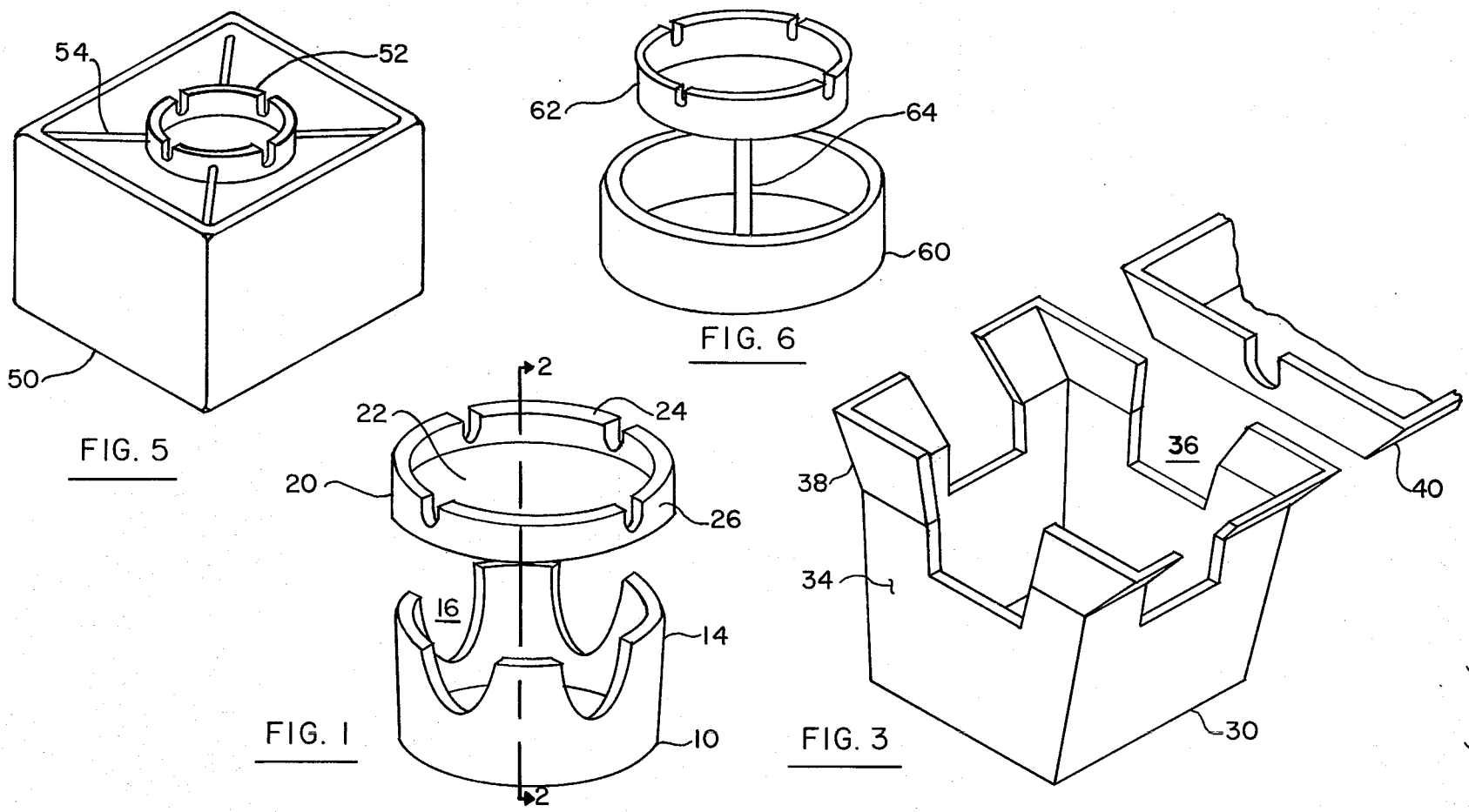
FIG. 1 is an exploded perspective view of a receptacle according to a first embodiment of the present invention.
FIG. 3 is an exploded perspective view of a receptacle according to an alternate embodiment of the present invention.
FIG. 5 is a perspective view of a receptacle according to a second alternate embodiment of the present invention.
FIG. 6 is a perspective view of a receptacle according to a third alternate embodiment of the present invention.
Figure 2:
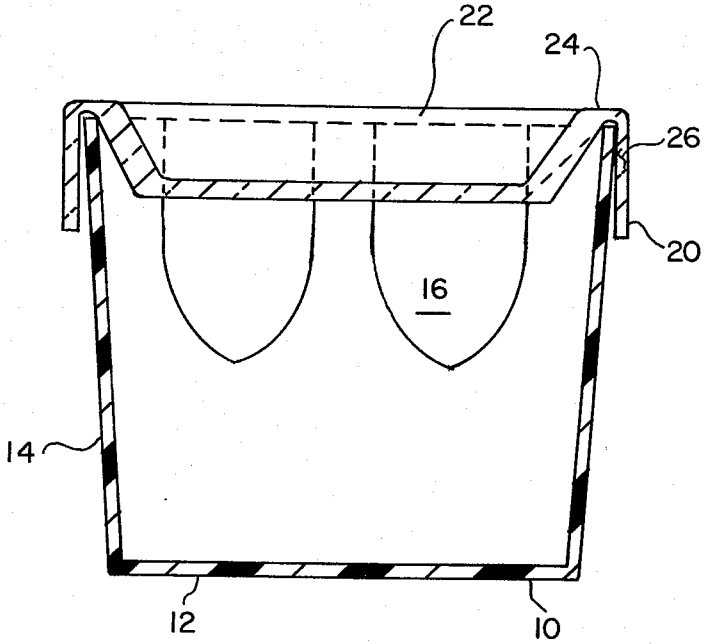
FIG. 2 is a sectional view taken substantially along lines 2—2 of FIG. 1.

Turning now to a discussion of the preferred embodiment of the present invention for a combined ash and trash receptacle, as illustrated in FIGS. 1 and 2 a first embodiment of the combined receptacle R includes a base container 10 which is a receptacle for trash and an upper container 20 which is a receptacle for ashes and means for joining upper container 20 and base container 10. Although the preferred is as illustrated and described, it is obvious the containers could be reversed so that the upper container receives trash and the lower receives ashes.

Base container 10 is formed, in a conventional manner such as molding, of relatively hard, plastic material and has a substantially circular bottom wall 12, and adjoining generally cylindrical wall 14, and an open top. In the cylindrical side wall 14 one or more relatively wide openings 16 extend from the top edges of the side wall downwardly a distance approximately equal to one-half the total height of the side wall 14. Trash is deposited through openings 16 into the receptacle base member 10.

preferably, upper member 10 is made of glass because of its resistance to heat from cigarette, cigar or pipe ashes and matches. However, other heat and flame resistant material such as metal, heat resistant polymers, or ceramics, for example, may be used. Upper container 20, in FIG. 1 includes a generally circular, shallow, bowl-shaped portion 22 surrounded at the upper outer edge by an annular flange 24 with a depending side rim 26. The outer diameter of the bowl area 22 should not be greater than the inner diameter of base container 10, and preferably should be just slightly smaller to approximately coincide therewith. The surrounding flange 24 should extend out over the upper edge of base container 10. Upper container 20 is removably supported on the top edge of side wall 14 of container 10 by flange 24 as illustrated in FIG. 2 to form the combined receptacle. To empty and clean the container, the two parts are separated.

Figure 4:
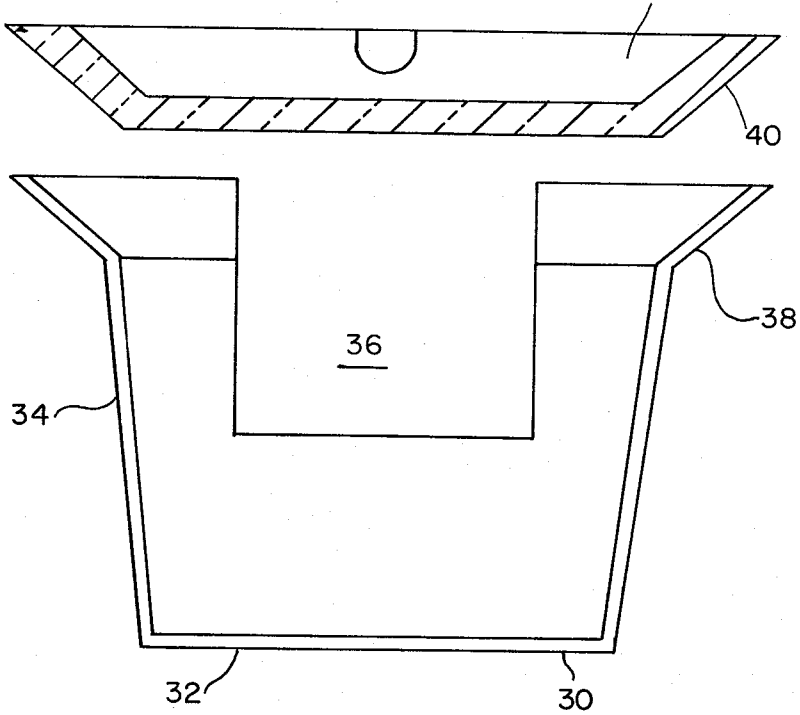
FIG. 4 is a sectional view taken substantially along lines 3—3 of FIG. 3.

In FIGS. 3 and 4 a second generally rectangular embodiment is shown which includes a base container 30 and upper container 40. A square or rectangular bottom or floor 32 includes planar side walls 34 extending upwardly therefrom with an upper flared portion forming a supporting rim 38. One or more cutouts 36, corresponding to openings 16 in FIGS. 1 and 2 extend from an upper edge down into side walls 34. Upper container 40 includes flared side walls 42 which permit said upper container to fit snugly within supporting rim 38 in the assembled condition.

In FIG. 5, a third embodiment is shown in which base container 50 and upper ash container 52 are permanently joined by support ribs 54 which connect the side walls of base container 50 with the periphery of ash container 52, while allowing access to base container 50 between the side walls of the base container and the periphery of ash container 52. In FIG. 6 a pedestal 64 connects base container 60 with ash container 62.

Although several preferred embodiments of the invention have been illustrated and described in detail, it is apparent that other changes in shape and size and modifications, including reversing positions of the containers, might be made without departing from the scope of the invention which is limited only by the following claims.

What is claimed is:

1. A receptacle for separately receiving tobacco ashes and trash in a single article of manufacture comprising:

a. a base container of such a size as to fit inconspicuously on a conventional dinner table and including a bottom wall, at least one side wall extending upwardly from said bottom wall, and an upper edge portion on said side wall surrounding and defining an open top portion;

b. an upper container including a solid bottom wall preventing communication therethrough into said base container and a side wall extending upwardly therefrom;

c. means associated with said upper edge portion of said base container and the side wall of said upper container to removably support said upper container on said base container;

d. at least one access opening in said side wall of said base container, said access opening including a relatively wide opening extending from said upper edge downwardly a distance such that an opening of sufficient size to receive table trash therethrough is formed below the bottom wall of said upper container when in an assembled position on the upper edge of said base container;

e. at least the bottom wall of said upper container being formed of a material which is heat resistant to live cigarette, cigar, or pipe ashes.

2. The receptacle according to claim 1 wherein said upper edge portion on said base container comprises an annular flared portion extending upwardly and outwardly from said side wall of the base container and forming a supporting rim, and wherein said means for supporting said upper container comprises flared side walls on said upper container conforming in shape and dimension to the corresponding shape and dimension of said flared portion whereby said upper container fits within said flared portion.

3. The receptacle according to claim 1 wherein the diameter of said upper container is substantially equal to the diameter of said upper edge portion of said base container.

* * * * *